US005535642A

United States Patent [19]

Moll

[11] Patent Number: 5,535,642

[45] Date of Patent: Jul. 16, 1996

[54] FOOT OPERATED VARIABLE RESISTANCE ELECTRICAL CONTROL WITH SWITCH

[76] Inventor: James E. Moll, 9690 Ridgeview Trail, Concord Township, Ohio 44060

[21] Appl. No.: 492,168

[22] Filed: Jun. 19, 1995

[51] Int. Cl.[6] ..... G05G 1/14

[52] U.S. Cl. ..... 74/561; 74/89.19; 74/512; 74/514; 74/560; 200/86.5

[58] Field of Search ..... 74/89.19, 512, 74/514, 560, 561; 338/13, 25, 29, 85; 200/86.5

[56] References Cited

U.S. PATENT DOCUMENTS

| | | | |
|---|---|---|---|
| 2,866,024 | 12/1958 | Ginn | 200/86.5 |
| 2,893,284 | 7/1959 | Washington, Jr. | 74/512 |
| 2,985,031 | 5/1961 | Bennett | 74/561 |
| 2,986,953 | 6/1961 | Armond et al. | 74/561 |
| 3,103,905 | 9/1963 | Althens et al. | 74/561 |
| 4,322,711 | 3/1982 | Spangler et al. | 74/512 |

FOREIGN PATENT DOCUMENTS

| | | | |
|---|---|---|---|
| 2104401 | 8/1972 | Germany | 200/86.5 |
| 610200 | 6/1978 | U.S.S.R. | 74/512 |

OTHER PUBLICATIONS

Linemaster Switch Corporation, Brochure Entitled "Linemaster—America's Foot Switch Leader," Sep. 1984, pp. 1–28, Especially p. 7.

PowCon Incorporated, Brochure Entitled "Welding & Cutting Power Sources for the Construction Industry," 1993, pp. 1–6, Especially p. 6.

*Primary Examiner*—Charles A. Marmor
*Assistant Examiner*—Chong H. Kim
*Attorney, Agent, or Firm*—David A. Burge

[57] ABSTRACT

A foot operated electrical control has a generally rectangular housing for protectively enclosing operating components, formed by a base and a treadle-type cover that have overlying sets of opposed side walls. A mounting shaft extends through aligned holes formed through the side walls to mount the treadle on the base for relative pivotal movement between a normal "non-operated" position and a range of "operated" positions. The operating components include a pair of arms that are connected to the operating shaft for relative pivotal movement between an "off" position and a range of "operating" positions, a first spring that biases the arms toward their "off" position, and a second spring that biases one arm into engagement with the base and also biases the treadle toward its "non-operated" position. A variable resistance potentiometer connected to the one arm has a control shaft that mounts a pinion. A gear rack connected to the other arm engages the pinion to rotate the control shaft in response to relative movement of the arms. A switch that is also connected to the other arm has an actuator that is disengaged by the treadle when both the other arm is in its "off" position and the treadle is in its "non-operated" position. Movement of the treadle from its "non-operated" position causes the switch to operate before the arms are moved relative to each other to cause the rack and pinion to rotate the control shaft of the potentiometer.

18 Claims, 4 Drawing Sheets

FOOT OPERATED VARIABLE RESISTANCE ELECTRICAL CONTROL WITH SWITCH

BACKGROUND OF THE INVENTION

1. Field of the Invention

The present invention relates to an improved, foot operated electrical control that has an easy-to-assemble set of operating components including an electrical switch and a variable resistance potentiometer that are carried by a pair of operating arms that, in turn, are mounted for relative pivotal movement on a common mounting shaft that also pivotally connects a base and treadle-type cover that cooperate to protectively house the operating components. More particularly, the present invention relates to a foot operated electrical control of the type just described having an electrical switch and a variable resistance potentiometer that are mounted on separate, relatively movable operating arms, with the switch being arranged to be operated at a time before a control shaft of the potentiometer is begun to be rotated in response to depression by one's foot of the treadle-type cover to cause the treadle to move relative to the base from a normal, "non-operated" position to within a range of "operated" positions.

2. Prior Art

Foot operated electrical controls that include a switch and a variable resistance potentiometer for controlling operation of such equipment as power sources for TIG and MIG types of welding equipment and the like, are well known, and are available for commercial purchase as stand-alone products from a variety of sources.

One such control can be purchased with an electrical switch of either the "momentary" or "maintained" contact type, and with one of a selection of variable resistance potentiometers that have ranges extending from as small as a zero to fifty Ohms, to as large as zero to five MegOhms. However this commercially available control has a number of drawbacks which have long presented a need for improvement.

One drawback of the aforementioned control is that its switch actuates at a time after its potentiometer shaft has begun to rotate in response to downward foot pressure on a treadle-type cover of the unit—whereby some of the so-called "lower end" range of resistance of the potentiometer is "lost," which can cause welding equipment or other equipment that is controlled by the unit to be inoperable within a desirable "lower end" of its range of performance.

Another drawback of the aforementioned control is that all but one of its several operating components are mounted (typically by threaded fastener connections) to the base of the unit, with the unit's only operating arm being separately connected to a mounting shaft that pivotally connects the treadle-type cover to the base—an arrangement that necessitates careful positioning during assembly of the switch and the potentiometer so that these operating components will be properly engaged and operated by separate formations of the operating arm when the operating arm is moved out of its normal "non-operated" position in response to depression of the treadle-type cover by the foot of an operator.

Another drawback of the aforementioned control is that a gear rack that is carried by the single operating arm, and a pinion that is mounted on an operating shaft of the potentiometer (a pinion that is rotated by the gear rack when the single operating arm is moved relative to the base) are positioned relatively "openly" and "exposed" within the relatively large confines of a generally rectangular housing that is cooperatively defined by the base and by the treadle-type cover—a non-sealed enclosure within which dust and particulate from welding environments and the like tend to collect, the presence of which can cause the operation and the operating life of the gear rack and/or the pinion to be unsatisfactory.

Still another drawback of the aforementioned control is that it utilizes a single spring that is interposed between the base and the treadle-type cover to bias the treadle upwardly away from the base toward a "non-operated" position, and to thereby effectively bias the treadle-engaged operating arm toward its "off" position wherein the operating arm does not actuate the switch—a spring that, if broken, permits the treadle to drop under the influence of gravity to actuate the switch and to rotate the potentiometer control shaft toward its so-called "high end" resistance setting which, in turn, tends to fully power control-connected equipment such as the power supply of a welder. The possibility that a broken spring of the control may cause fullest power operation of connected equipment presents a safety concern.

SUMMARY OF THE INVENTION

The present invention addresses the foregoing and other needs and drawbacks of the prior art by providing a foot operated control that can utilize the same type of base and treadle housing that is utilized by the aforementioned control (thereby enabling controls of the aforementioned type to be retrofitted with the improved operating component assembly of the present invention, if desired), and which provides an improved operating component assembly that requires neither the use of fasteners nor the expenditure of time-consuming effort to connect operating components directly to the base, but rather provides an easy and inexpensive to assemble, shaft-mounted set of operating components including a pair of operating arms, one of which supports and properly positions a potentiometer and a pinion for rotating the control shaft of the potentiometer, and the other of which supports and properly positions an electrical switch and a gear rack for rotating the pinion during relative movement of the two operating arms.

A complete foot control unit that embodies the preferred practice of the present invention includes a generally rectangular housing of a known type for protectively enclosing an electrical switch and a variable resistance potentiometer. An upper part of the housing is formed by an inverted pan-shaped treadle that has opposed, depending side and end walls. A lower part of the housing is formed by an upward opening pan-shaped base that has opposed, upstanding side and end walls that extend along inner surfaces the side and end walls of the treadle. A mounting shaft extends through aligned holes formed through the overlying side walls of the treadle and the base to mount the treadle on the base for pivotal movement relative to the base between a "non-operated" position and a range of "operated" positions.

Protectively enclosed within the generally rectangular housing are first and second operating arms that are connected to the mounting shaft at a central location along its length to mount the operating arms for pivotal movement relative to each other between an "off" position and a range of "operating" positions. A first spring is interposed between the first and second operating arms and biases the operating arms toward their "off" position. A second spring is interposed between the first operating arm and the treadle-type cover to maintain engagement between the first operating arm and a bottom wall of the base, and to effectively bias the treadle relative to the base toward the treadle's "non-operated" position.

In preferred practice, each of the operating arms carries a separate sub-set of the operating components of the foot operated control unit. The first operating arm carries the potentiometer and a toothed pinion that is mounted on the rotatable control shaft of the potentiometer. The second operating arm carries the electrical switch and a toothed gear rack for engaging the toothed pinion to rotate the control shaft during relative movement of the operating arms within the range of "operating" positions.

Proper positioning of the interactive operating components (so that the teeth of the rack and pinion will properly engage to operate the potentiometer during relative movement of the operating arms, and so that the electrical switch will be engaged and properly operated by the treadle) is achieved simply by journaling the operating arms on the mounting shaft that also is used to pivotally mount the treadle-type cover on the base (i.e., by inserting through holes that are formed in the operating arms the mounting shaft that slip-fits within the holes to establish substantially play-free pivotal connections between the operating arms and the mounting shaft). No direct connection of any of the operating components to the base or to the treadle-type cover needs to be provided.

A feature of the present invention resides in the fact that its switch and potentiometer are arranged to be operated sequentially. Depression of the treadle first causes the switch to be actuated, then begins rotating the control shaft of the potentiometer through its full range of variable resistance—whereby connected equipment can be "turned on" by the switch before the potentiometer shaft starts to rotate, so that none of the "low end" control of welding equipment or the like that is connected to the unit is lost due to the switch being actuated at a time after the potentiometer has begun moving through its range of variable resistance. In preferred practice, this desirable type of sequential operation of the switch and the potentiometer is achieved through the provision of what is referred to by those who are skilled in the art as a "lost motion connection" that enables initial movement of the treadle from of its "non-operated" position to not cause corresponding relative movement of the operating arms until this initial movement of the treadle has been utilized to operate the switch.

Another safety feature of a foot operated control that embodies the preferred practice of the present invention is that electrical switch has an actuator that is completely disengaged by the treadle when the treadle is in its normal, "non-operated" position—to ensure that, if the foot operated control is inadvertently bumped or jostled, resulting minor movement of the treadle relative to the base will not cause the electrical switch to be operated unintentionally. Stated in another way, the "lost motion" movement of the treadle that needs to take place before the actuator of the electrical switch will be operated by the treadle tends not to be achieved as a result of the foot operated control's being inadvertently bumped or jostled.

A further feature of the present invention resides in its use of a pair of springs, one of which biases the operating arms toward their "off" position, the other of which biases the treadle-type cover toward its "non-operated" position. In preferred practice, the arrangement of these springs is such that, should either of the springs break, the biasing action of the spring that remains operable will be utilized by the unit to "power down" and/or to "turn off" connected equipment by rotating the control shaft of the potentiometer toward a "low range" setting and/or by deactivating the electrical switch.

Still another feature of the preferred practice of the present invention resides in the use of a pair of operating arms that cooperate to protectively enclose a pinion that is carried on the control shaft of the potentiometer so that, even if some dust and debris from a welding environment should accumulate within the confines of the non-sealed housing that is defined by the base and treadle-type cover, minimal dust and debris will be permitted to enter the protectively enclosed region surrounding the pinion (i.e., the region in which the toothed pinion and the gear rack drivingly engage)—a feature that facilitates obtaining good operation of and a more extended operating life from the gear rack and from the pinion.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 2:
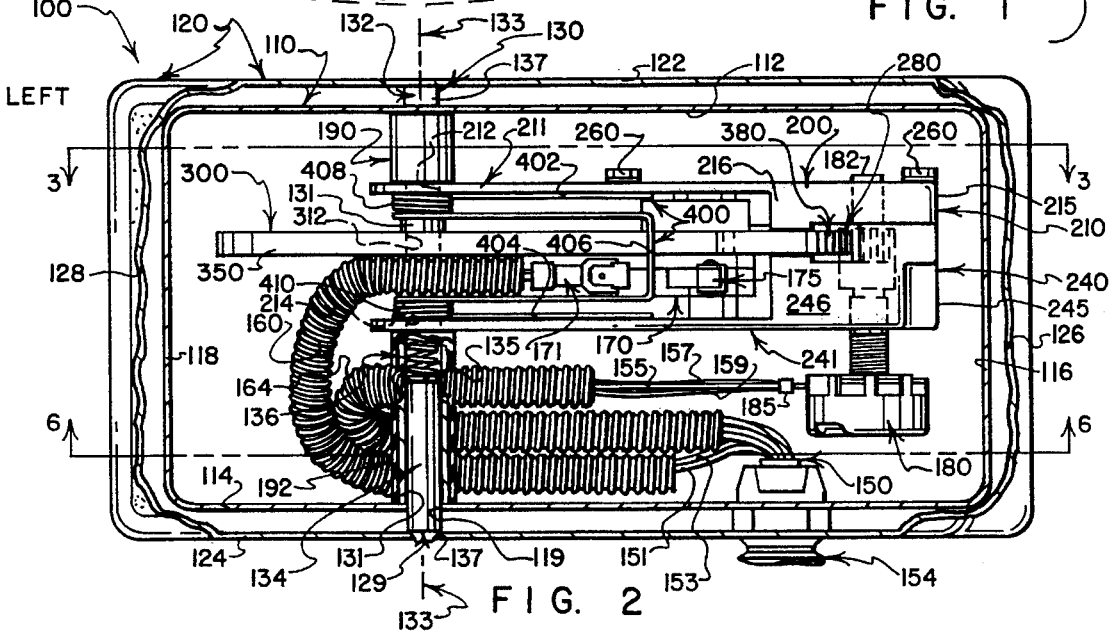
FIG. 2 is a top plan view thereof, with central portions of the treadle-type cover of the control broken away, and with selected component portions located near one end of a mounting shaft broken away.
Figure 3:
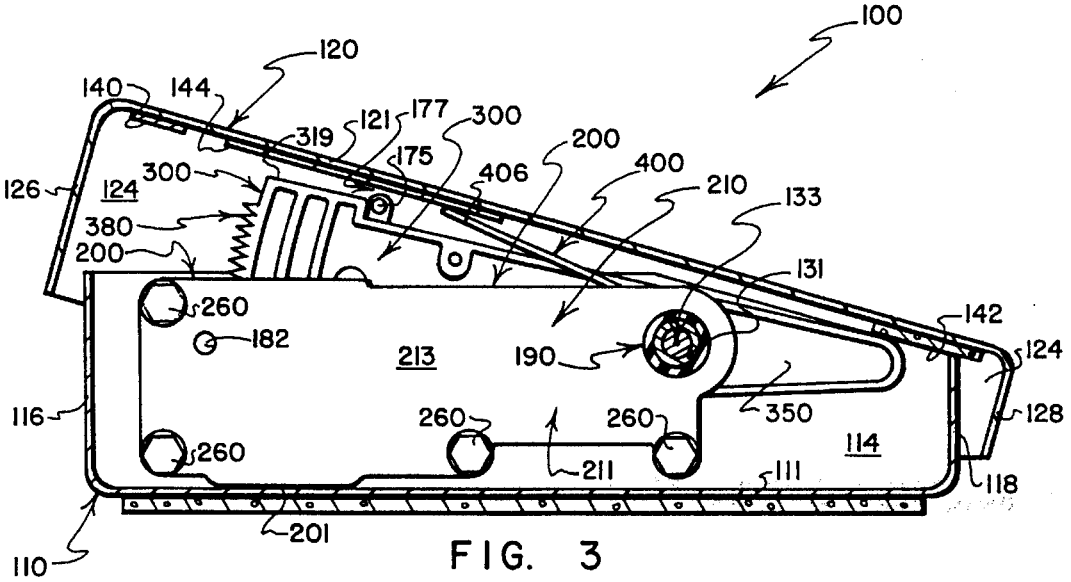
FIG. 3 is a sectional view, as seen from a plane indicated by a line 3—3 in FIG. 2, with a second operating arm of the control pivoted (relative to a first operating arm of the control) to an "off" position.
Figure 4:
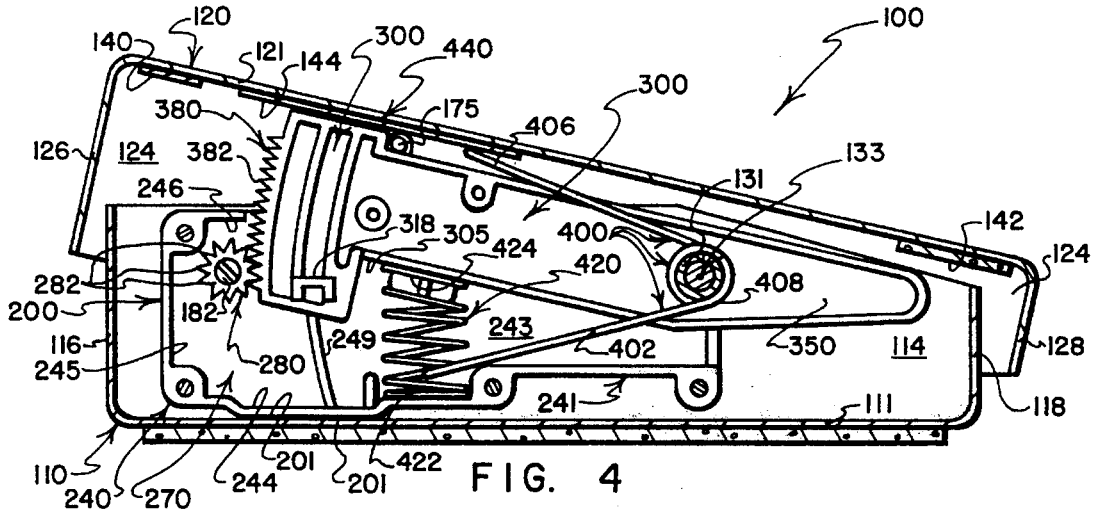
FIG. 4 is a sectional view similar to FIG. 3 but with portions of the first operating arm removed to permit portions of the second operating arm to be viewed, with the second operating arm shown in its "off" position, and with the treadle-type cover pivoted (relative to the base about the mounting shaft) to a "switch operated" position wherein the treadle engages an actuator arm of an electrical switch to operate the switch.
Figure 5:
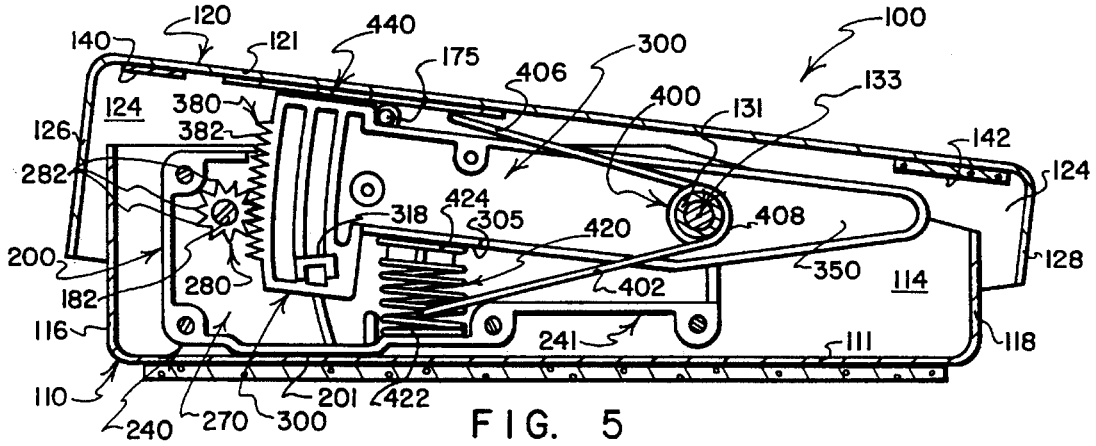
FIG. 5 is a sectional view similar to FIG. 3, but with the treadle-type cover pivoted to within its range of "operated" positions to cause corresponding pivotal movement of the second operating arm from its "off" position to within its range of "operating" positions.
Figure 6:
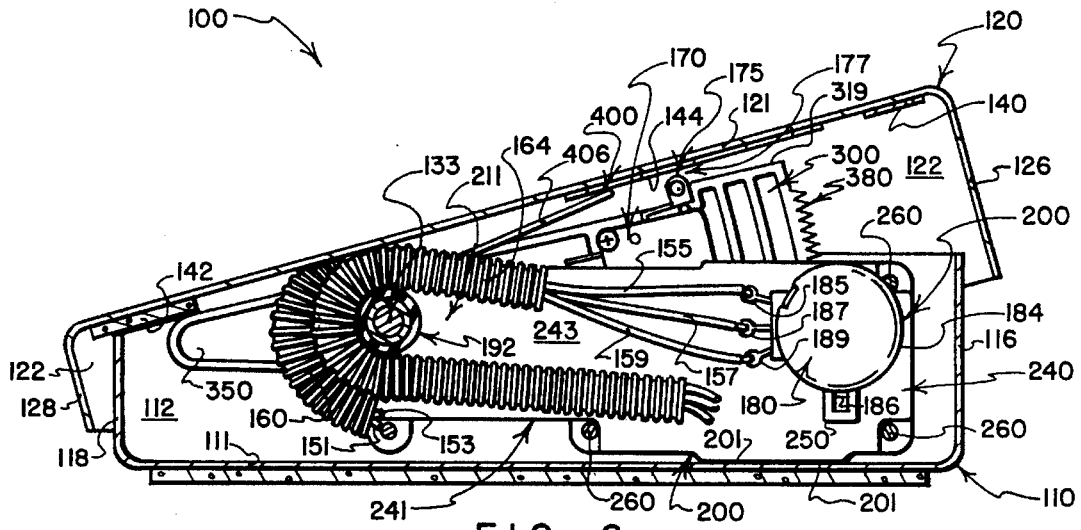
FIG. 6 is a sectional view, as seen from a plane indicated by a line 6—6 in FIG. 2.
Figure 7:
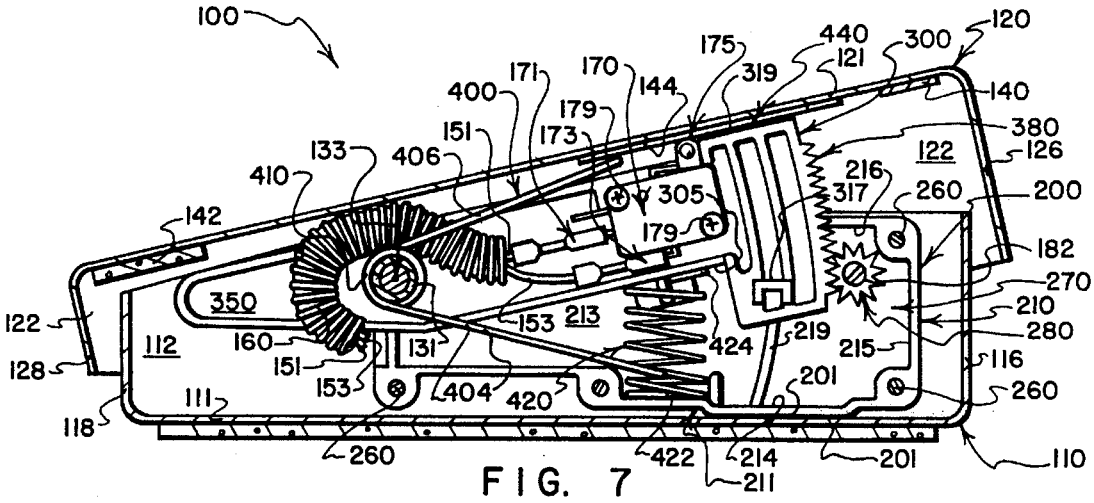
FIG. 7 is a sectional view similar to FIG. 6 but with portions of the first operating arm removed to permit portions of the second operating arm to be viewed, with the second operating arm in its "off" position, and with the treadle-type cover pivoted to the "switch operated" position (as is also depicted in FIG. 4)
Figure 8:
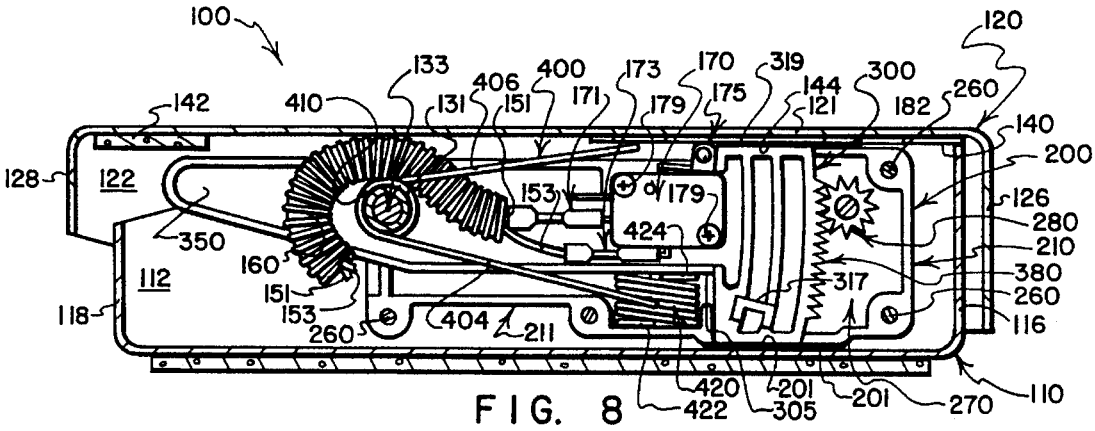
FIG. 8 is a sectional view similar to FIG. 7, but with the treadle-type cover pivoted to the "high end" of its range of "operated" positions to cause corresponding pivotal movement of the second operating arm from its "off" position to the "high end" of its range of "operating" positions.

Referring to FIGS. 1–8, a foot operated electrical control that embodies the preferred practice of the present invention is indicated generally by the numeral 100. The control 100 has a generally rectangular base 110 and a generally rectangular treadle-type cover 120 (also referred to herein as "treadle 120"). The base 110 and the treadle 120 are connected by a mounting shaft assembly 130 for relative pivotal movement about an imaginary center axis 133 of the shaft assembly 130 between a normal, "non-operated" position that is depicted in FIGS. 1–3 and 6, through a "switch-operated" position that is depicted in FIGS. 4 and 7, to an "operated" position that resides within a range of possible "operated" positions (such as are depicted in FIGS. 5 and 8).

Whereas the "operated" position of the treadle 120 that is depicted in FIG. 5 is approximately mid-way through the range of possible "operated" positions, the treadle position that is depicted in FIG. 8 is at the so-called "high end" of the range of "operated" positions. The treadle position that is depicted in FIGS. 4 and 7 is at the so-called "low end" of the "operated" position range.

Referring to FIGS. 3 and 6, the base 110 has a generally rectangular bottom wall 111, a pair of upstanding, opposed side walls 112, 114, and a pair of upstanding, opposed end walls 116, 118. The treadle 120 has a generally rectangular top wall 121, a pair of upstanding, opposed side walls 122, 124, and a pair of upstanding, opposed end walls 126, 128. In preferred practice, the base 110 and the treadle 120 are each deep drawn metal members (i.e., press-formed from separate pieces of metal, typically steel).

Figure 1:
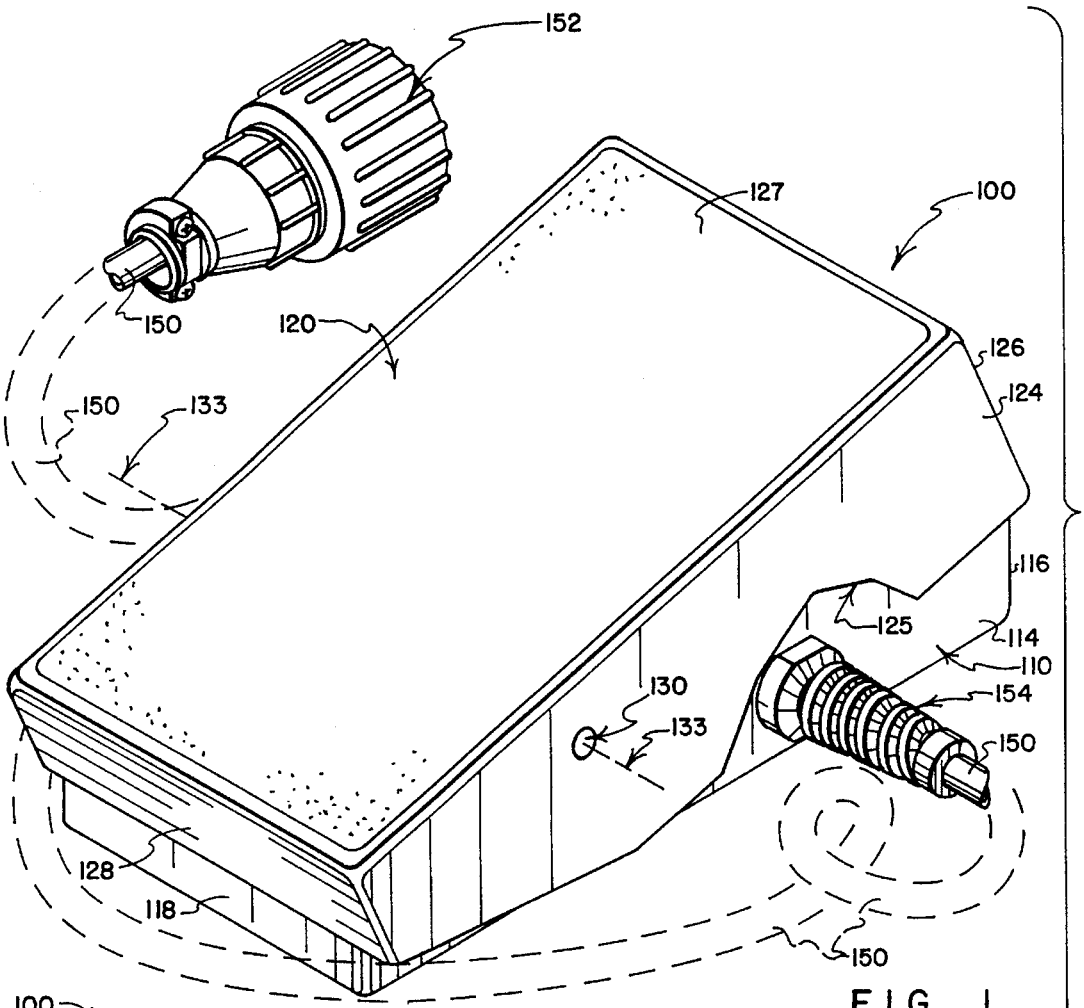
FIG. 1 is a perspective view of exterior portions of a foot operated control that embodies the preferred practice of the present invention, with a treadle-type cover of the control in its normal, "non-operated" position, and with an electrical hook-up wire of the control shown foreshortened.

Referring to FIG. 1, a rectangular area of non-slip surface material 127 is provided on the upper surface of the top wall 121 of the treadle 120 to help prevent the shoe of an operator from inadvertently slipping out of engagement with the treadle 120 when the control 100 is to be foot operated.

Referring to FIGS. 3–8, a pair of resilient bumper pads 140, 142 are provided on the under side of the top wall 121 near opposite end regions thereof for selectively engaging upper edges of the end walls 116, 118 of the base 110 when the treadle 120 is at opposite ends of its range of pivotal movement. In FIGS. 3 and 6 the bumper pad 142 is shown engaging the upper edge of the end wall 118 when the treadle 120 is at one end of its permitted range of pivotal movement, referred to as the normal, "non-operated" position. In FIG. 8, the bumper pad 140 is shown engaging the upper edge of the end wall 116 when the treadle 120 is at the other end of its range of pivotal movement, referred to as the "high end" of the range of "operated" positions."

A thin film of smooth surface, tear resistant, insulating material 144 is adhered to the under side of the top wall 121 at a location spaced between the locations of the bumper pads 140, 142, for electrically insulating a first operating arm assembly 200 from the treadle 120, and for providing a minimal friction medium that is interposed between the first operating arm assembly 200 and the underside of the top wall 121 of the treadle 120. A resilient bumper pad 201 is carried on a bottom portion of the first operating arm assembly 200 for cushioning the engagement of the first operating arm assembly 200 with the upper surface of the bottom wall 111 of the base 110.

Referring to FIG. 2, the mounting shaft assembly 130 (also referred to herein as "mounting shaft 130") includes an elongate, tubular member 131, into opposite end regions of which are inserted a pair of identically configured, generally cylindrical plug members 132, 134. The plug members 132, 134 are slidably carried within the tubular member 131. A compression coil spring 136 is interposed between opposed inner ends 135 (only one of the inner ends 135 is shown in FIG. 2) to oppositely bias the plug members 132, 134 so that outer ends 137 of the plug members 132, 134 tend to project outwardly from opposite end regions of the tubular member 131.

The plug members 132, 134 have substantially uniform diameters along their lengths except for their outer end regions 137 which are of slightly reduced diameter. Aligned holes 119, 129 (one of each of which is depicted in FIG. 2) are formed through the opposed side walls 112, 114 of the base 110, and through the opposed side walls 122, 124 of the treadle 120, respectively. The holes 119 that are formed through the base side walls 112, 114 are sized to receive in a slip fit the uniform diameter portions of the plug members 132, 134. The holes 129 that are formed through the treadle are sized to receive in a slip fit the reduced diameter outer end regions 137 of the plug members 132, 134. By this arrangement, the treadle 120 is pivotally mounted on the base 110.

Referring to FIG. 1, a plural-conductor electrical hook-up cable 150 having a suitable electrical connector 152 at one end thereof, is connected by a conventional, resilient strain relief 154 to the base 110. The side wall 124 of the treadle 120 is notched, as indicated by the numeral 125, to ensure that, as the treadle 120 pivots about an imaginary center axis 133 of the mounting shaft 130, the side wall 124 of the treadle 120 does not come into contact with the strain relief 154.

Referring to FIG. 2 and to FIGS. 7 and 8, a pair of wires 151, 153 of the cable 150 extend through a flexible protective tube 160 for connection to terminals 171, 173 of an electrical switch 170. Referring to FIG. 2 and to FIG. 6, three additional wires 155, 157, 159 of the cable 150 extend through a flexible protective tube 164 for connection to terminals 185, 187, 189 of a variable resistance potentiometer 180. If desired or required, a ground wire (not shown) also can be included in the plural-conductor cable 150 for connection to the base 110 and/or to the treadle 120 of the unit 100.

Referring to FIG. 2, the first operating arm 200 assembly (also referred to herein as "first operating arm 200") includes a pair of spaced, parallel-extending leg portions 211, 241 that have aligned mounting holes 212, 242 (see FIGS. 9 and 10) through which the tubular member 131 of the shaft assembly 130 extends to pivotally mount the first operating arm 200 on the mounting shaft assembly 130 at a location approximately mid-way along the length of the mounting shaft 130. In this description, the leg portion 211 will be referred to as a "left" leg portion, whereas the leg portion 241 will be referred to as a "right" leg portion.

A second operating arm 300 is situated between the left and right leg portions 211, 241 of the first operating arm. A mounting hole 312 (see FIGS. 11 and 12), journals the tubular member 131 to pivotally mount the second operating arm 300 on the mounting shaft assembly 130.

Referring to FIG. 2, left and right tubular spacers 190, 192 are installed on the tubular member 131 to position the first operating arm assembly 200 at a desired location along the mounting shaft assembly 130. The left spacer 190 is interposed between the left leg portion 211 and the side wall 112 of the base 110. The right spacer 192 is interposed between the right leg portion 241 and the side wall 114 of the base 110.

As is best seen in FIG. 2, the first operating arm 200 actually is an assembly of left and right arm components 210, 240. The left leg portion 211 is an integral part of the left arm component 210. The right leg portion 241 is an integral part of the right arm component 240. Referring to FIG. 3, four threaded fasteners 260 rigidly connect the left and right arm components 210, 240. In preferred practice, the left and right arm components 210, 240 and the second operating arm 300 are formed from rigid plastic material through the use of convention injection molding techniques.

Figure 9:
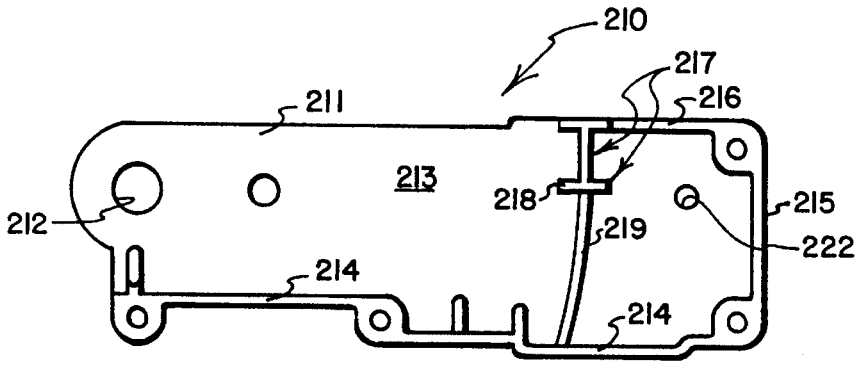
FIG. 9 is a side elevational view of the right side (i.e., the "interior" side) of the left arm component of the first operating arm.

In FIG. 3, the outer surface of an upstanding side wall 213 of the left arm component 210 is depicted, whereas, in FIG. 9, the inner surface of the side wall 213 is depicted. Likewise, in FIG. 6, the outer surface of an upstanding side wall 243 of the right arm component 220 is depicted, whereas, in FIG. 10, the inner surface of an upstanding side wall 243 is depicted.

Referring to FIG. 9, the left arm component 210 has, in addition to the upstanding side wall 213, a bottom wall 214, a front end wall 215, and a short top wall 216. An inverted T-shaped formation 217 depends from the top wall 216, with the cross-bar of the "T" providing a downwardly facing stop surface 218 that is engaged by a right stop surface 318 (see FIG. 12) of the second operating arm 300 when the second operating arm 300 is in its "off" position, which position is depicted in FIGS. 3 and 6. A thin reinforcement web 219 depends from the stop surface 218 and connects with the bottom wall 214.

Figure 10:
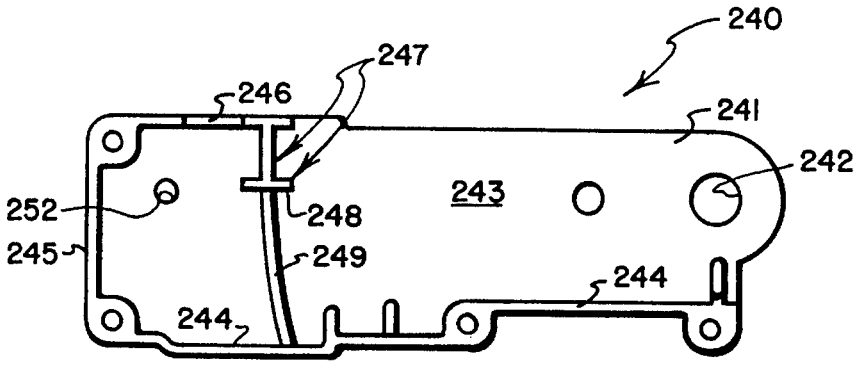
FIG. 10 is a side elevational view of the left side (i.e, the "interior" side) of the right arm component of the first operating arm; and, FIGS. 11 and 12 are side elevational views of opposite sides of the second operating arm.

Referring to FIG. 10, the right arm component 240 has, in addition to the upstanding side wall 243, a bottom wall 244, a front end wall 245, and a short top wall 246. An inverted T-shaped formation 247 depends from the top wall 246, with the cross-bar of the "T" providing a downwardly facing stop surface 248 that is engaged by a left stop surface 317 (see FIG. 11) of the second operating arm 300 when the second operating arm 300 is in its "off" position, which position is depicted in FIGS. 3 and 6. A thin reinforcement web 249 depends from the stop surface 248 and connects with the bottom wall 244.

Referring to FIGS. 4, 5, 7 and 8, the front end walls 215, 245, the top walls 216, 246, the inverted T-shaped formations 217, 247, the reinforcement webs 219, 249, and the bottom walls 214, 244 cooperate to define an enclosed region 270 through which a control shaft 182 of the potentiometer 180 extends, and within which a pinion 280 is affixed to the control shaft 182 (preferably by a tightening a pinion-carried set screw, not shown, against the control shaft 182). The enclosed region 270 that protectively surrounds the pinion 280 helps to keep dust and debris from accumulating in the vicinity of the pinion 280, thereby promoting proper operation of the pinion 280 in maintaining driving engagement with a toothed gear rack 380 that is carried by the second operating arm 300.

Referring to FIG. 6, the potentiometer 180 has a generally cylindrical casing 184, projecting from which is a mounting tab 186. The mounting tab 186 extends into a tab-receiving formation 250 of the side wall 243 of the right arm component 210 to ensure that the potentiometer casing 184 does not rotate relative to the first operating arm 200 when the control shaft 182 of the potentiometer 180 is rotated by the pinion 280. Opposite end regions of the control shaft 182 are journaled for rotation in aligned holes 222, 252 (see FIGS. 9 and 10) that are formed in upstanding side walls 213, 243 of the left and right arm components 210, 240.

The pinion 280 has teeth 282 that are drivingly engaged by teeth 382 of the gear rack 380. When the second operating arm 300 is pivoted about the imaginary center axis 133 of the mounting shaft 130 relative to the first operating arm 200, the engagement of the teeth 282, 382 of the pinion 280 and the gear rack 380 cause the pinion 280 to rotate the control shaft 182 to cause the electrical resistance of the potentiometer 180 to be adjusted in accordance with the relative position of the operating arms 200, 300 (i.e., in accordance with the position of the second operating arm 300 within its range of "operating" positions).

Figure 11:
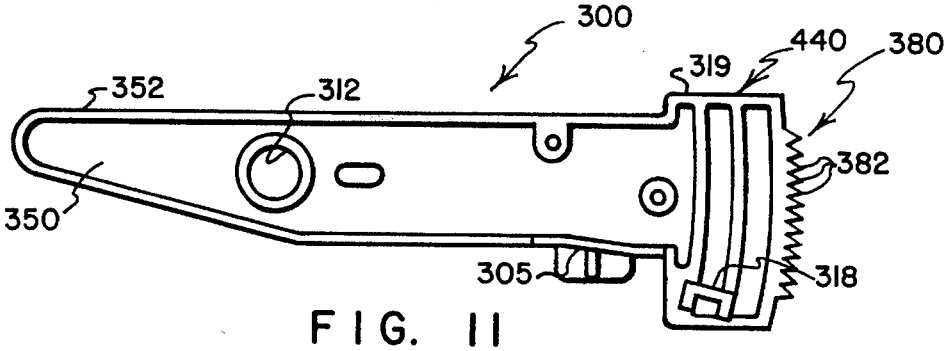
Figure 12:
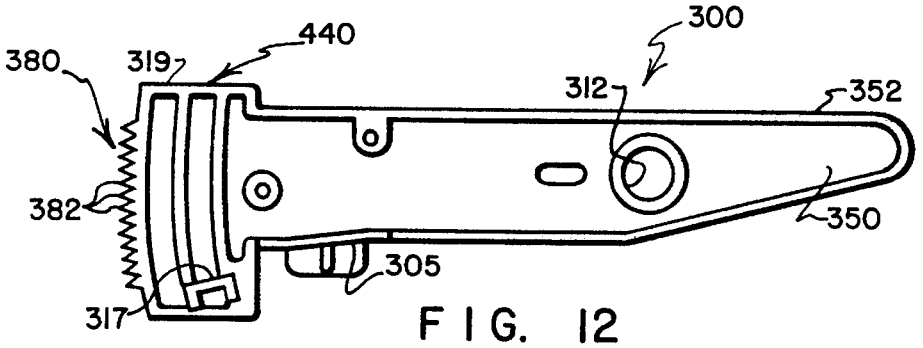

Referring to FIGS. 11 and 12, the second operating arm 300 is an elongate member that has the gear rack 380 integrally formed near one of its ends, and has a tapered end region 350 at the other of its ends. The tapered end region 350 has an upwardly facing surface 352 that is provided to engage the bumper pad 142 that is carried on the underside of the top wall 121 of the treadle 120 to ensure that the second operating arm 300 will return to its "off" position in the event that the treadle 120 is forceably returned to its "non-operated" position.

Referring to FIGS. 7 and 8, two threaded fasteners 179 are provided to mount the switch 170 on the right side of the second operating arm 300 such that an actuator arm 175 of the switch 170 projects slightly above an adjacent upper surface 319 of the second operating arm. When the treadle 120 is in its "non-operated" position (as depicted in FIGS. 3 and 6), the switch actuator arm 175 is disengaged by the treadle 120. However, when the treadle 120 is pivoted sufficiently from its "non-operated" position (for example, as is depicted in FIGS. 4 and 7), the switch actuator arm 175 engages the insulating film 144 that is carried on the underside of the top surface 121 of the treadle 120.

Referring to FIGS. 2–8, a torsion coil spring 400 is interposed between the first operating arm 200 and the treadle 120 to bias the first operating arm 200 toward a position of engagement with the bottom wall 111 of the base 110, and to bias the treadle 120 toward its "non-operated" position. The spring 400 is formed from a single piece of spring wire that defines relatively straight left and right end regions 402, 404, a generally U-shaped central region 406, a left coil 408 that is interposed between the left end region 402 and the U-shaped central region 406, and a right coil 410 that is interposed between the right end region 404 and the U-shaped central region 406. The left and right end regions 402, 404 engage the bottom walls 214, 244 of the left and right arm members 210, 240. The U-shaped central region 406 engages the insulating film 144 that is carried on the underside of the top wall 121 of the treadle 120. The left coil 408 wraps about the tubular member 131 at a location spaced between the second operating arm 300 and the left leg portion 211 of the first operating arm 200. The right coil 410 wraps about the tubular member 131 at a location spaced between the second operating arm 300 and the right leg portion 241 of the first operating arm 200.

Referring to FIGS. 4, 5, 7 and 8, a compression coil spring 420 is interposed between the first and second operating arms 200, 300 to bias the second operating arm 300 away from the first operating arm 200 toward the "off" position wherein the left and right stop surfaces 317, 318 of the second operating arm 300 engage the stop surfaces 218, 248 of the left and right arm members 210, 240 of the first operating arm assembly 200. The spring 420 has a bottom end 422 that engages the bottom walls 214, 244 of the left and right arm members 210, 240, and a top end 424 that engages a downwardly-facing surface 305 (see FIGS. 11 and 12) of the second operating arm 300.

A safety feature that arises from the above-described arrangement of the springs 400, 420 is that, in the event that either of the springs 400, 420 should break or otherwise become inoperative, the spring 400 or 420 that remains in service will still function to bias the treadle 120 toward its "non-operated" position. If, for example, the torsion spring 400 breaks, the compression coil spring 420 will still act to bias the first and second operating arms 200, 300 away from each other—and, the engagement of the first operating arm 200 with the bottom wall 111 of the base 110, taken together with the engagement of the second operating arm 300 with the top wall 121 of the treadle 120 will bias the treadle to the position that is depicted in FIGS. 4 and 7 (wherein the switch 170 still is being operated by the treadle 120, but the potentiometer 180 has been adjusted to its "low end" setting).

On the other hand, if the compression coil spring 420 breaks, the torsion spring 400 will continue to perform its normal function of biasing the treadle 120 relative to the base 110 to the "non-operated" position depicted in FIGS. 3 and 6—and, the engagement of the tapered end region 350 of the second operating arm 300 with the underside of the top wall 121 of the treadle 120 will cause the second operating arm 300 to return to its "off" position, whereby the switch 170 is caused to "turn off," and wherein the potentiometer 180 is adjusted to its "low end" setting.

In operation, the end connector 152 of the cable 150 is connected to a conventional piece of equipment such as a power supply unit for a welder (not shown) that is to be operated by the foot operated control unit 100. By way of example, welder power supply units for TIG and MIG welding that are well suited for being controlled by the unit 100 are sold by PowCon Incorporated of San Diego, Calif. 92126 under model numbers 300ST, 400SS and 400SM. PowCon also sells, as an accessory for these power supply units, a foot-operated variable resistance control with switch of the type described in the introduction hereto.

When the foot-operated treadle 120 of the unit 100 is in its normal, "non-operated" position (as is depicted in FIGS. 1–3 and 6), the following is true: 1) the operating arms 200, 300 are in their "off" position; 2) the control shaft 182 of the potentiometer 180 is rotated to the "low end" of its range of variable resistance; 3) the switch actuator 175 is in its "switch non-actuated" position; and 4) the underside of the top wall 121 of the treadle 120 is raised out of engagement with the switch actuator 175 so that a space or "gap" of about 0.060 inch, indicated by the numeral 177 in FIGS. 3 and 6, exists between the switch actuator 175 and the underside of the treadle top wall 121.

Initial pivotal movement of the foot-operated treadle 120 away from its "non-operated" position does nothing more than to progressively close the gap 177. What the gap 177 does, in effect, is to provide the treadle 120 with a brief range of non-functional travel that must be traversed in moving the treadle 120 between the normal, "non-operated" position and the "switch operated" position—thereby establishing what is referred to by those who are skilled in the art as a "lost motion connection" between the treadle 120 and the switch actuator 175 (or, stated in another way, between the treadle 120 and the first operating arm 200). The presence of this "lost motion" connection provides a safety feature in helping to ensure that inadvertent jostling of the control unit 100 (causing minor unintended movement of the treadle 120) will not cause the switch actuator 175 to be depressed by the treadle 120 so as to initiate the operation of equipment that is controlled by the unit 100.

After pivotal movement of the treadle 120 away from its normal, non-operated position brings the treadle 120 into engagement with the switch actuator 175, further pivotal movement of the treadle 120 in the same direction will cause the switch actuator 175 to operate the switch 170, as is depicted in FIGS. 4 and 7—which actuation may be "momentary" or "maintained" (with the "maintained" actuation being either "normally open" or "normally closed") depending on the character of the switch 170 that is selected for installation in the unit 100.

Continued pivotal movement of the treadle 120 in the same direction brings the underside of the top wall 121 of the treadle into engagement with the first operating arm 200 at a location that is indicated by an arrow 440 in FIGS. 4 and 7, which engagement is maintained and causes the first operating arm 200 to pivot about the axis 133 together with the treadle 120 away from the "low end" of its range of "operating" positions toward the "high end" of its range of "operating" positions.

During relative movement of the first and second operating arms 200, 300, the teeth 382 of the gear rack 380 of the first operating arm 200 drivingly engage and rotate the teeth 282 of the pinion 280, with the result that the control shaft 182 of the potentiometer 180 is caused to rotate to adjust the resistance of the potentiometer 180 away from the "low end" of its range toward the "high end" of its range. Such relative arm movement and potentiometer adjustment may be continued (under increasing depression of the treadle 120 by the foot of an operator) until the treadle 120 reaches the "high end" of its possible range of pivotal movement, as is depicted in FIG. 8.

Once foot pressure on the treadle 120 has been released, the biasing action of the springs 400, 420 causes return pivotal movement of the treadle 120 to be carried out in a way that represents a simple reverse of the sequence of events that have just been described, causing the resistance of the potentiometer 180 to be adjusted to its "low end" before the switch actuator 175 is released from being engaged by the treadle 120.

As will be apparent from the foregoing description, the present invention provides a novel and improved foot control that incorporates desirable safety features, that provides for a proper sequence of operation of an electrical switch and a variable resistance potentiometer, and that has a set of shaft-mounted operating components that are easy to assembly and do not require direct fastening to either of the base or the treadle-type cover of the control unit.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall treadle, by suitable expression in the claims, such features of patentable novelty exist in the invention.

What is claimed is:

1. In a foot operated control of the type having a housing including a base and a treadle-type cover that cooperate to define an enclosed chamber for protectively housing operating components that include a switch, a variable resistance potentiometer, and a rack and pinion for rotating a control shaft of the potentiometer, with the treadle-type cover being pivotally connected to the base by means of a mounting shaft that extends through the enclosed chamber, with the treadle-type cover being pivotally movable relative to the base about an imaginary center axis of the mounting shaft between a "non-operated" position and a range of "operated" positions, the improvement comprising:

a) first elongate arm means and second elongate arm means that are connected to the mounting shaft for relative pivotal movement about the imaginary center axis of the mounting shaft between an "off" position and a range of "operating" positions;

b) first spring means interposed between the first arm means and the treadle-type cover for biasing the first arm means toward a position of engagement with the base, and for biasing the treadle-type cover relative to the base toward the "non-operated" position;

c) second spring means interposed between the first arm means and the second arm means for biasing the second arm means relative to the first arm means toward the "off" position; and, d) with operating components that include: a switch having an actuator that is movable between a normal "switch non-actuated" position and a "switch actuated" position, with the actuator being biased toward the "switch non-operated" position; a variable resistance potentiometer having a control shaft for adjusting the resistance of the potentiometer; and a toothed gear rack and a pinion for rotating the control shaft of the potentiometer to adjust the electrical resistance of the potentiometer; and, wherein:

i) the potentiometer is connected to and positioned by the first arm means, with the pinion being mounted on the control shaft of the potentiometer for rotating the control shaft to vary the resistance of the potentiometer in response to rotation of the pinion by the rack;

ii) the toothed gear rack is connected to the second arm means and is positioned by the second arm means to drivingly engage the pinion and to rotate the pinion during pivotal movement of the second arm means about the imaginary center axis of the mounting shaft relative to the first arm means; and, iii) the electrical switch is connected to the second arm means for movement therewith, with the actuator of the switch being configured and positioned by the second arm means 1) to be disengaged by the treadle-type cover when the treadle-type cover is in the "non-operated" position, and 2) to be engaged by the treadle-type cover and to be moved as the result of such engagement to the "switch operated" position during movement of the treadle-type cover from the "non-operated" position to a position within the range of "operated" positions, with said movement of the switch actuator to the "switch operated" position taking place before the treadle-type cover moves the second operating arm from its "off" position, whereby operation of the switch takes place before the control shaft of the potentiometer is caused to be rotated during said movement of the treadle-type cover.

2. The foot operated control of claim 1 wherein the second operating arm positions the switch such that, when the second operating arm is in the "off" position, and when the treadle-type cover is in the "non-operated" position, a space exists between the switch actuator and the treadle-type cover to ensure that, if the foot operated control is inadvertently jostled causing minor movement of the treadle-type cover, said minor movement of the cover will not be sufficient to traverse said space and to move the switch actuator to the "switch operated" position.

3. The foot operated control of claim 1 wherein the first spring means is a torsion coil spring having a coiled region interposed between first and second relatively straight portions of the torsion coil spring, with the coiled region being wrapped about the mounting shaft, with the first straight portion engaging the first arm means, and with the second straight portion engaging the treadle-type cover.

4. The foot operated control of claim 1 wherein the second spring means is a compression coil spring having one end region that engages the first arm means, and having a second end region that engages the second arm means.

5. The foot operated control of claim 1 wherein the first arm means is an assembly of left and right elongate arm components that are rigidly connected for concurrent movement, that each are pivotally mounted on the mounting shaft, that each extends along an opposite side of the second arm means, and that define portions which cooperate to protectively shroud a region wherein the toothed gear rack drivingly engages the pinion.

6. The foot operated control of claim 5 wherein the left and right elongate arm components define substantially parallel-extending left and right side walls through which are formed aligned holes that journal spaced portions of the control shaft of the potentiometer.

7. A set of operating components for use in a foot operated control of the type having a housing including a base and a treadle-type cover that cooperate to define an enclosed chamber for protectively housing the operating components, with the treadle-type cover being pivotally connected to the base by means of a mounting shaft that extends through the enclosed chamber, with the cover being pivotally movable relative to the base about an imaginary center axis of the mounting shaft between a "non-operated" position and a range of "operated" positions, comprising:

a) first elongate arm means and second elongate arm means for being connected to the mounting shaft for relative pivotal movement about the imaginary center axis of the mounting shaft between an "off" position and a range of "operating" positions;

b) first spring means for being interposed between the first arm means and the treadle-type cover for biasing the first arm means toward a position of engagement with the base, and for biasing the treadle-type cover relative to the base toward the "non-operated" position;

c) second spring means for being interposed between the first arm means and the second arm means for biasing the second arm means relative to the first arm means toward the "off" position; and, d) with the operating components also including: a switch having an actuator that is movable between a "switch non-operated" position and a "switch operated" position, with the actuator being biased toward the "switch non-operated" position; a variable resistance potentiometer having a control shaft for adjusting the resistance of the potentiometer; and a toothed gear rack and a pinion for rotating the control shaft of the potentiometer to adjust the electrical resistance of the potentiometer; wherein:

i) the potentiometer is connected to and positioned by the first arm means, with the pinion being mounted on the control shaft of the potentiometer for rotating the control shaft to vary the resistance of the potentiometer in response to rotation of the pinion by the rack;

ii) the toothed gear rack is connected to the second arm means and is positioned by the second arm means to drivingly engage the pinion and to rotate the pinion during pivotal movement of the second arm means about the imaginary center axis of the mounting shaft relative to the first arm means; and, iii) the electrical switch is connected to the second arm means for movement therewith, with the actuator of the switch being configured and positioned by the second arm means 1) to be disengaged by the treadle-type cover when the treadle-type cover is in the "non-operated" position, and 2) to be engaged by the treadle-type cover and to be moved as the result of such engagement to the "switch operated" position during movement of the treadle-type cover from the "non-operated" position to a position within the range of "operated" positions, with said movement of the switch actuator to the "switch operated" position taking place before the treadle-type cover moves the second operating arm from its "off" position, whereby operation of the switch takes place before the control shaft of the potentiometer is caused to be rotated during said movement of the treadle-type cover.

8. The set of operating components of claim 7 wherein the second operating arm positions the switch such that, when the second operating arm is in the "off" position, and when the treadle-type cover is in the "non-operated" position, a space exists between the switch actuator and the treadle-type cover to ensure that, if the foot operated control is inadvertently jostled causing minor movement of the treadle-type cover, said minor movement of the cover will not be sufficient to traverse said space and to move the switch actuator to the "switch operated" position.

9. The set of operating components of claim 7 wherein the first spring means is a torsion coil spring having a coiled region interposed between first and second relatively straight portions of the torsion coil spring, with the coiled region being wrapped about the mounting shaft, with the first straight portion engaging the first arm means, and with the second straight portion engaging the treadle-type cover.

10. The set of operating components of claim 7 wherein the second spring means is a compression coil spring having one end region that engages the first arm means, and having a second end region that engages the second arm means.

11. The set of operating components of claim 7 wherein the first arm means is an assembly of left and right elongate arm components that are rigidly connected for concurrent movement, that each are pivotally mounted on the mounting shaft, that each extends along an opposite side of the second arm means, and that define portions which cooperate to protectively shroud a region wherein the toothed gear rack drivingly engages the pinion.

12. The set of operating components of claim 11 wherein the left and right elongate arm components define substantially parallel-extending left and right side walls through which are formed aligned holes that journal spaced portions of the control shaft of the potentiometer.

13. A foot operated control, comprising a housing including a base and a treadle-type cover that cooperate to define an enclosed chamber for protectively housing operating components of the control, and a mounting shaft that extends through the chamber and that mounts the treadle-type cover for pivotal movement relative to the base about an imaginary center axis of the mounting shaft between a "non-operated" position and a range of "operated" positions; and a set of operating components that include:

a) first elongate arm means and second elongate arm means for being connected to the mounting shaft for relative pivotal movement about the imaginary center axis of the mounting shaft between an "off" position and a range of "operating" positions;

b) first spring means for being interposed between the first arm means and the treadle-type cover for biasing the first arm means toward a position of engagement with the base, and for biasing the treadle-type cover relative to the base toward the "non-operated" position;

c) second spring means for being interposed between the first arm means and the second arm means for biasing the second arm means relative to the first arm means toward the "off" position; and, d) with the operating components also including: a switch having an actuator that is movable between a "switch non-operated" position and a "switch operated" position, with the actuator being biased toward the "switch non-operated" position; a variable resistance potentiometer having a control shaft for adjusting the resistance of the potentiometer; and a toothed gear rack and a pinion for rotating the control shaft of the potentiometer to adjust the electrical resistance of the potentiometer; wherein:

i) the potentiometer is connected to and positioned by the first arm means, with the pinion being mounted on the control shaft of the potentiometer for rotating the control shaft to vary the resistance of the potentiometer in response to rotation of the pinion by the rack;

ii) the toothed gear rack is connected to the second arm means and is positioned by the second arm means to drivingly engage the pinion and to rotate the pinion during pivotal movement of the second arm means about the imaginary center axis of the mounting shaft relative to the first arm means; and, iii) the electrical switch is connected to the second arm means for movement therewith, with the actuator of the switch being configured and positioned by the second arm means 1) to be disengaged by the treadle-type cover when the treadle-type cover is in the "non-operated" position, and 2) to be engaged by the treadle-type cover and to be moved as the result of such engagement to the "switch operated" position during movement of the treadle-type cover from the "non-operated" position to a position within the range of "operated" positions, with said movement of the switch actuator to the "switch operated" position taking place before the treadle-type cover moves the second operating arm from its "off" position, whereby operation of the switch takes place before the control shaft of the potentiometer is caused to be rotated during said movement of the treadle-type cover.

14. The foot operated control of claim 13 wherein the second operating arm positions the switch such that, when the second operating arm is in the "off" position, and when the treadle-type cover is in the "non-operated" position, a space exists between the switch actuator and the treadle-type cover to ensure that, if the foot operated control is inadvertently jostled causing minor movement of the treadle-type cover, said minor movement of the cover will not be sufficient to traverse said space and to move the switch actuator to the "switch operated" position.

15. The foot operated control of claim 13 wherein the first spring means is a torsion coil spring having a coiled region interposed between first and second relatively straight portions of the torsion coil spring, with the coiled region being wrapped about the mounting shaft, with the first straight portion engaging the first arm means, and with the second straight portion engaging the treadle-type cover.

16. The foot operated control of claim 13 wherein the second spring means is a compression coil spring having one end region that engages the first arm means, and having a second end region that engages the second arm means.

17. The foot operated control of claim 13 wherein the first arm means is an assembly of left and right elongate arm components that are rigidly connected for concurrent movement, that each are pivotally mounted on the mounting shaft, that each extends along an opposite side of the second arm means, and that define portions which cooperate to protectively shroud a region wherein the toothed gear rack drivingly engages the pinion.

18. The foot operated control of claim 13 wherein the left and right elongate arm components define substantially parallel-extending left and right side walls through which are formed aligned holes that journal spaced portions of the control shaft of the potentiometer.

* * * * *